United States Patent [19]

Ezawa et al.

[11] 4,443,054

[45] Apr. 17, 1984

[54] EARTH TERMINAL FOR ELECTRICAL EQUIPMENT

[75] Inventors: Masashi Ezawa; Hiroshi Makino, both of Kanagawa; Tadao Futami, Tokyo, all of Japan

[73] Assignees: Kanagawa Prefectual Government, Yokohama; Futami Plastic Industrial Co., Ltd., Musashimurayama, both of Japan

[21] Appl. No.: 380,437

[22] Filed: May 20, 1982

[30] Foreign Application Priority Data

Jun. 1, 1981 [JP] Japan ..... 56-079112

[51] Int. Cl.[3] ..... H01R 4/52; H01R 4/66; H01R 13/629

[52] U.S. Cl. ..... 339/273 R; 339/14 R; 339/75 R; 339/253 R

[58] Field of Search ..... 339/14 R, 14 L, 75 R, 339/80, 110 R, 252 R, 253 R, 253 S, 255 B, 258 R, 258 RR, 273 R, 273 S; 279/41 R, 51, 58

[56] References Cited

U.S. PATENT DOCUMENTS

| | | | |
|---|---|---|---|
| 2,567,727 | 9/1951 | Quackenbush | 339/75 R |
| 3,493,917 | 2/1970 | Glowacz | 339/74 R |
| 4,054,762 | 10/1977 | Knecht | 200/51 R X |

*Primary Examiner*—Eugene F. Desmond
*Assistant Examiner*—Steven C. Bishop
*Attorney, Agent, or Firm*—Holman & Stern

[57] ABSTRACT

An earth terminal for electrical equipment which is adapted to be attached to and detached from a ground pin. It comprises a collet having locking hooks capable of clamping a ground pin and engageable with a neck portion thereof, a main tubular body in which the collet is inserted in such a manner that the locking hooks project from a mouth thereof, a connector for an earth conductor, which is formed integrally with the tubular body, a shaft formed integrally with the collet and projecting partially from a rear end of the tubular body, a pair of operating levers through which a rear end portion of said shaft is inserted, a holding member consisting of a stop ring mounted fixedly on a rear tip portion of the shaft so as to receive one of the operating levers, a coil spring provided around a front end portion of the shaft so as to urge the collet in the forward direction, a pair of annular face cams, which are engaged with each other and which are formed integrally with the operating levers, respectively, so as to surround the shaft, and projections having inclined surfaces, formed on the outer surfaces of the locking hooks of the collet, and adapted to come into engagement with the mouth of the tubular body.

3 Claims, 6 Drawing Figures

EARTH TERMINAL FOR ELECTRICAL EQUIPMENT

BACKGROUND OF THE INVENTION

This invention relates to an earth terminal for electrical equipment.

The operation of a conventional earth terminal for electrical equipment is complicated. It does not fit around a ground pin reliably, and there is the possibility that it will come off unexpectedly. In addition, the contact resistance between the earth terminal and the ground pin is unstable. In the production of such an earth terminal, it is necessary that the material be subjected to a milling process, a process for making a positioning bore therein, a tapping process, and so on. Accordingly, it is difficult and expensive to manufacture such an earth terminal.

SUMMARY OF THE INVENTION

An object of the present invention is to provide an earth terminal which is free from the above-mentioned draw-backs encountered in the conventional earth terminal of this kind, and which can be operated easily with a small force, fitted reliably around a ground pin without a possibility that the earth terminal will be disengaged therefrom unexpectedly, maintains a stable contact resistance with the ground pin, minimizes the number of parts and manufacturing steps, and reduces the manufacturing cost.

In order to achieve the above object, the present invention is formed as follows.

The present invention provides an earth terminal for electrical equipment comprising a collet having locking hooks capable of clamping a ground pin and engageable with a neck portion thereof, a main tubular body in which the collet is inserted in such a manner that the locking hooks project from the mouth thereof, a connector for an earthing conductor, which is formed integrally with the tubular body, a shaft formed integrally with the collet and projecting partially from the rear end of the tubular body, a pair of operating levers through which a rear end portion of the shaft is inserted, a holding member consisting of a stop ring fixedly mounted on the rear tip of the shaft so as to receive one of the operating levers, a coil spring provided around the front end portion of the shaft so as to urge the collet in the forward direction, a pair of annular face cams engaged with each other and formed integrally with the respective operating levers so as to surround the shaft, and projections having inclined surfaces, formed on the outer surfaces of the locking hooks of the collet, and adapted to come into engagement with the mouth of the tubular body.

When the locking hooks of the collet, which project from the mouth of the main tubular body, are pressed against a ground pin against the resilient force of the coil spring, the projections having inclined surfaces disengage from the mouth of the tubular body. Consequently the collet, which is urged in the opening direction, opens as it is moved backward and allows the free end portion of the ground pin to enter the space between the locking hooks of the collet. When the ground pin has been inserted deep into this space the collet is moved forward by the resilient force of the coil spring, bringing the projections having inclined surfaces into engagement with the mouth of the tubular body and contracting the collet. At the same time, the locking hooks engage with the neck portion of the ground pin. Thus, the earth terminal according to the present invention is engaged with the ground pin. When the two operating levers are pressed inward by the fingertips with the earth terminal and ground pin in such an engaged state, the two annular face cams formed with the operating levers are disengaged from each other, drawing the shaft backward via the stop ring against the resilient force of the coil spring and opening the collet. Accordingly, the earth terminal can be freely removed from the ground pin. Thus, the earth terminal according to the present invention can be operated very naturally. It can also be operated easily and reliably even in emergencies or by a person who is inexperienced in handling earth terminals. Moreover, the two operating levers can be moved with a small force to disengage the collet from the ground pin, owing to the annular face cams formed integrally therewith. The present invention also permits a collet-slotting process employed in the production of conventional earth terminals to be omitted. Since the connector for an earthing conductor of the earth terminal according to the present invention is formed integrally with the tubular body, a process for making a mounting bore can be omitted. Therefore, this earth terminal can be manufactured by a turning process only.

In addition, the present invention permits the number of parts of the earth terminal to be minimized, simplifying its assembly and reducing the manufacturing cost.

Since the operating levers for the earth terminal according to the present invention are formed pivotably, the earth terminal is not operated unexpectedly even when it receives an external force. This earth terminal can be set on a ground pin simply by pressing it against the pin.

A flange for receiving one end of the coil spring is provided on the outer surface of a boundary region between the collet and shaft, and a nut for receiving the other end of the coil spring is screwed to male threads formed on the tubular body. The spring-receiving flange is preferably formed wide enough to allow the flange to enclose the free end portion of the ground pin when the collet is fitted around the ground pin. This permits the neck and free end portion of the ground pin engaged with the collet to be fixed in a stable condition by the locking hooks of the collet and the spring-receiving flange. Therefore, even when the ground pin and collet are twisted about the same axis, the pin is not displaced therefrom, and the collet is not damaged. Moreover, the contact resistance between the ground pin and earth terminal can be kept stable.

If a hollow is formed in the central portion of the connector for an earthing conductor, with a recess provided in its outer surface, the connector breaks at the recess if an external force is applied to it by accident, for example, if someone's foot catches the earthing conductor. This prevents the equipment from being dropped or falling. When the connector is broken, the earthing conductor can be temporarily connected by press-fitting a metal rod, such as a nail, into the hollow therein.

The above and other objects as well as advantageous features of the invention will become apparent from the following description of a preferred embodiment taken in conjunction with the accompanying drawings.

BRIEF DESCRIPTION OF THE DRAWINGS

The accompanying drawings illustrate an embodiment of an earth terminal for electrical equipment according to the present invention, wherein.

DESCRIPTION OF THE PREFERRED EMBODIMENT

Figure 1:
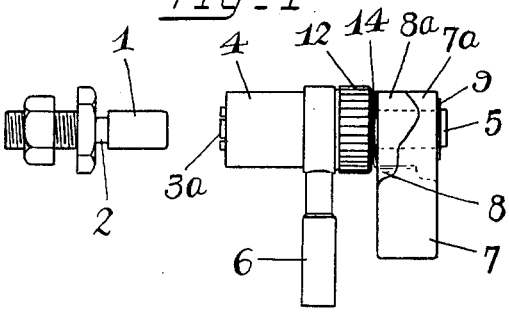
FIG. 1 is a side elevational view.
Figure 2:
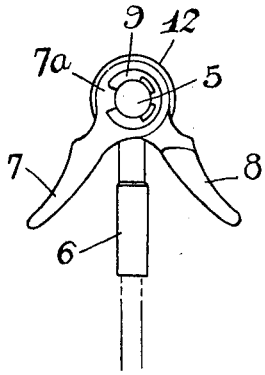
FIG. 2 is a front elevational view.
Figure 3:
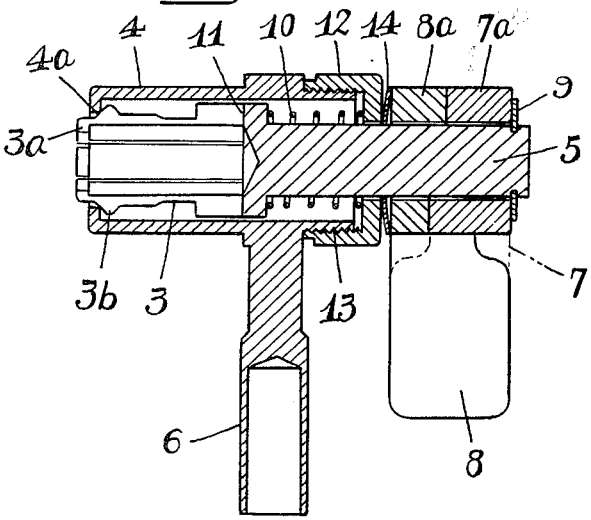
FIG. 3 is a side elevational view in longitudinal section.
Figure 5:
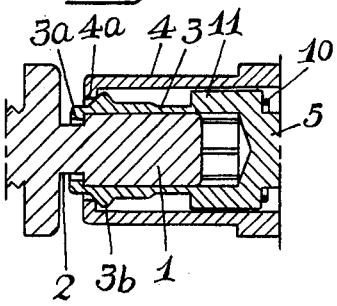
FIG. 5 is a cross-sectional view, in which the collet is fit around a ground pin.
Figure 4:
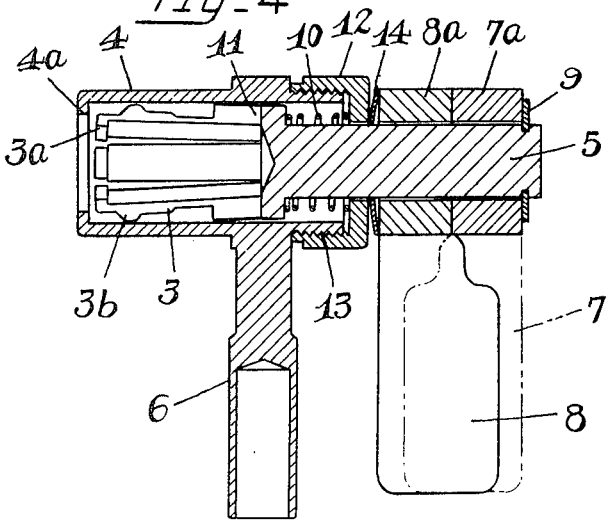
FIG. 4 is a side elevational view in longitudinal section, in which a collet is opened.

The earth terminal for electrical equipment according to the present invention comprises a collet 3 having locking hooks 3*a* capable of clamping a ground pin 1 and engageable with a neck 2 thereof, a main tubular body 4 in which the collet 3 is inserted in such a manner that the locking hooks 3*a* project from a mouth 4*a* thereof, a connector 6 for an earthing conductor, which is formed integrally with the tubular body 4, a shaft 5 formed integrally with the collet 3 and projecting partially from the rear end of the tubular body 4, a pair of operating levers 7, 8 through which a rear end portion of the shaft 5 is inserted, a holding member consisting of a stop ring 9 mounted fixedly on the rear tip of the shaft 5 so as to receive one of the operating levers 7, 8, a coil spring 10 provided around the front end of the shaft 5 so as to urge the collet 3 in the forward direction, a pair of annular face cams 7*a*, 8*a*, which are engaged with each other, and which are formed integrally with the operating levers 7, 8, respectively, so as to surround the shaft 5, and projections 3*b* having inclined surfaces, formed on the outer surfaces of the locking hooks 3*a* of the collet 3, and adapted to come into engagement with the mouth 4*a* of the tubular body 4.

The present invention has the above-described construction. When the locking hooks 3*a* of the collet 3, which project from the mouth 4*a* of the main tubular body 4, are pressed against a ground pin 1 against the resilient force of the coil spring 10, the projections 3*b* having inclined surfaces are disengaged from the mouth 4*a* of the tubular body 4. Consequently, the collet 3, which is urged in the opening direction, opens as it is moved backward to allow the free end of the ground pin 1 to enter the space between the locking hooks 3*a* of the collet 3. When the ground pin 1 has been inserted deep into the above-mentioned space, the collet 3 is moved forward by the resilient force of the coil spring 10. As a result, the projections 3*b* having inclined surfaces come into engagement with the mouth of the tubular body 4, so that the collet 3 is contracted. At the same time, the locking hooks 3*a* come into engagement with a neck portion 2 of the ground pin 1. Thus, the earth terminal according to the present invention is engaged with the ground pin 1. When the two operating levers 7, 8 are pressed in by fingertips with the earth terminal and ground pin 1 in such an engaged state, the two annular face cams 7*a*, 8*a* formed with the operating levers 7, 8 are disengaged from each other. This draws shaft 5 backward via the stop ring 9 against the resilient force of the coil spring 10, so that the collet 3 is opened. Accordingly, the earth terminal can be removed from the ground pin 1 freely. Thus, the earth terminal according to the present invention can be operated very naturally. It can also be operated easily and reliably even in emergencies or by a person who is inexperienced in handling earth terminals. Moreover, both of the operating levers 7, 8 can be moved with a small force owing to the annular face cams 7*a*, 8*a* formed integrally therewith to disengage the collet 3 from the ground pin 1. The present invention also permits omitting a collet-slotting process employed in the production of conventional earth terminals. Since the connector 6 for an earth conductor, in the earth terminal according to the present invention is formed integrally with the tubular body, the process for making a mounting bore can be omitted. Therefore, this earth terminal can be manufactured by a turning process only. In addition, the present invention permits the number of parts of the earth terminal to be minimized, simplifying assembly and reducing the manufacturing cost.

Since the operating levers for the earth terminal according to the present invention are formed pivotably, the earth terminal is not operated unexpectedly even when it receives an external force. This earth terminal can be set on a ground pin simply by pressing it against the pin.

Figure 6:
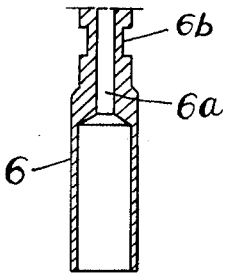
FIG. 6 is a sectional view of another example of a connector for an earth conductor.

In the embodiment shown in the drawings, a flange 11 for receiving one end of the coil spring 10 is provided on the outer surface of a boundary region between the collet 3 and shaft 5, and a nut 12 for receiving the other end of the coil spring is screwed to a male thread 13 formed on the tubular body 4. The spring-receiving flange 11 is formed wide enough to allow the flange 11 to enclose the free end portion of the ground pin 1 when the collet 3 is fitted around the ground pin 1. This permits the neck 2 and free end portion of the ground pin 1 engaged with the collet 3 to be fixed in a stable condition by the locking hooks 3*a* of the collet 3 and the spring-receiving flange 11. Therefore, even when the ground pin 1 and collet 3 are twisted about the same axis, the pin is not displaced, and the collet is not damaged. Moreover, the contact resistance between the ground pin 1 and earth terminal can be kept stable. Referring to the drawings, reference numeral 14 denotes a wave shaped washer provided between the main tubular body 4 and operating lever 8. In the example of the connector 6 for an earth conductor shown in FIG. 6, a hollow 6*a* is formed in its center and a recess 6*b* is provided in its outer surface, so the connector 6 will break at the recess 6*b* if an external force is accidentally applied, for example, when someone's foot catches the earth conductor. This can prevent the equipment from being dropped or falling. When the connector 6 is broken, the earth conductor can be temporarily connected by press-fitting a metal rod, such as nail, into the hollow 6*a*.

The earth terminal according to the present invention is used mainly for medical electrical equipment. It can also be utilized for general household electric appliances.

The present invention is not, of course, limited to the above-described embodiment; it may be modified in various ways within the scope of the appended claims.

What is claimed is:

1. An earth terminal for electrical equipment which is adapted to be attached to and detached from a ground pin, comprising a collet having locking hooks capable of clamping a ground pin and engageable with a neck portion thereof; a main tubular body into which said collet is inserted in such a manner that said locking hooks project from a mouth thereof; a connector for an earth conductor, which is formed integrally with said tubular body; a shaft formed integrally with said collet and partially projecting from the rear end of said tubular body; a pair of operating levers through which a rear end portion of said shaft is inserted; a holding member consisting of a stop ring mounted fixedly on a rear tip portion of said shaft so as to receive one of said operating levers; a coil spring provided around a front end portion of said shaft so as to urge said collet in the forward direction; a pair of annular face cams which are engaged with each other and which are formed integrally with said operating levers, respectively, so as to surround said shaft; and projections having inclined surfaces, formed on the outer surfaces of said locking hooks of said collet, and adapted to come into engagement with said mouth of said tubular body.

2. An earth terminal for electrical equipment as claimed in claim 1, wherein said earth terminal further includes a spring-receiving flange provided on the outer surface of a boundary region between said collet and said shaft, and having a width large enough to allow said flange to enclose the free end portion of said ground pin when said collet is fitted around said ground pin.

3. An earth terminal for electrical equipment as claimed in claim 1, wherein said connector for an earthing conductor is provided with a hollow in the central portion thereof, and a recess in the outer surface thereof.

* * * * *